US007086338B2

(12) United States Patent
Horiuchi

(10) Patent No.: US 7,086,338 B2
(45) **Date of Patent: *Aug. 8, 2006**

(54) CORRUGATED CARDBOARD PALLET

(75) Inventor: Yasuhiko Horiuchi, Yamato-Koriyama (JP)

(73) Assignee: The Pack America Corp., New York, NY (US)

( * ) Notice: Subject to any disclaimer, the term of this patent is extended or adjusted under 35 U.S.C. 154(b) by 79 days.

This patent is subject to a terminal disclaimer.

(21) Appl. No.: 10/942,173

(22) Filed: Sep. 16, 2004

(65) Prior Publication Data

US 2005/0126449 A1 Jun. 16, 2005

Related U.S. Application Data

(63) Continuation-in-part of application No. 10/446,223, filed on May 28, 2003, and a continuation-in-part of application No. PCT/JP03/06584, filed on May 26, 2003, now Pat. No. 6,948,434.

(51) Int. Cl.
*B65D 19/00* (2006.01)

(52) U.S. Cl. ..... 108/51.3

(58) Field of Classification Search ..... 108/51.3, 108/51.11, 56.1, 56.3
See application file for complete search history.

(56) References Cited

U.S. PATENT DOCUMENTS

| | | | | |
|---|---|---|---|---|
| 2,583,443 | A * | 1/1952 | Perry et al. | 108/51.3 |
| 2,728,545 | A * | 12/1955 | Hermitage | 108/51.3 |
| 2,957,668 | A * | 10/1960 | Norquist et al. | 108/51.3 |
| 3,425,367 | A * | 2/1969 | Oravez | 108/51.3 |
| 3,434,435 | A * | 3/1969 | Achermann et al. | 108/51.3 |
| 3,881,429 | A * | 5/1975 | Seymore | 108/51.3 |
| 4,966,084 | A * | 10/1990 | Motomaru | 108/51.3 |
| 5,285,731 | A * | 2/1994 | McIntyre | 108/51.3 |
| 5,809,903 | A * | 9/1998 | Young, Jr. | 108/51.3 |
| 5,881,652 | A * | 3/1999 | Besaw | 108/51.3 |
| 6,948,434 | B1 * | 9/2005 | Horiuchi | 108/51.3 |

* cited by examiner

*Primary Examiner*—Jose V. Chen
(74) *Attorney, Agent, or Firm*—Pitney Hardin LLP

(57) ABSTRACT

The present disclosure provides a corrugated cardboard pallet, wherein beam members and pallet deck plates of the corrugated cardboard pallet are both made of corrugated cardboard, as well as a method of manufacturing same.

9 Claims, 10 Drawing Sheets

CORRUGATED CARDBOARD PALLET

CROSS-REFERENCE TO RELATED APPLICATIONS

This application is a continuation-in-part (CIP) of U.S. patent application Ser. No. 10/446,223, filed May 28, 2003, and is also a CIP of International Application No. PCT/JP03/06584, filed May 26, 2003, now U.S. Pat. No. 6,948,434 in which the United States of America is designated.

FIELD OF THE INVENTION

The present invention relates to a corrugated cardboard pallet wherein beam members and pallet deck plates of the corrugated cardboard pallet are both made of corrugated cardboard, and to a method of manufacturing a corrugated cardboard pallet.

BACKGROUND OF THE INVENTION

A variety of corrugated cardboard pallets constructed with beam members and pallet deck plates of conventional technology have been proposed to replace metallic or wooden pallets that have conventionally been used in the transportation industry.

Corrugated cardboard pallets of conventional technology can roughly be classified into two types: (1) a core type, having a core of beam members bonded to the bottom surface of a beam member made of a flat corrugated cardboard, which is further wrapped into a roll, or having a core of multiple flat corrugated cardboards stacked atop each other; and (2) a hollow type, having hollow beam members.

The present applicant has proposed a hollow type corrugated cardboard pallet as disclosed in Japanese Unexamined Patent Publication No. 2002-370738. The corrugated cardboard pallets of this type have load-bearing portions, which provide far better pressure resistance than the hollow type corrugated cardboard pallets of conventional technology.

Nonetheless, a beam member of the above corrugated cardboard pallet has edges where the corrugated cardboard pallet is cut across and exposed to the surrounding environment such that, when rain falls into the open surface of the edges, the corrugated cardboard pallet absorbs water therefrom, thereby deteriorating the pressure resistance thereof.

Understanding the above technical background, the objective of the present invention is to improve the pressure resistance of corrugated cardboard pallets and to provide waterproofing without using a waterproof coating or water-repelling technique and without deteriorating its pressure resistance.

SUMMARY OF THE INVENTION

To overcome the above problem, the present invention provides a corrugated cardboard pallet whose edges are folded inside such that the edges cut open cannot be exposed, thereby making little water absorption possible therethrough and making the edges folded inside pressure-resistant.

More specifically, the present invention employs the following configuration: the corrugated cardboard pallet has: a pallet deck plate fixed on top of multiple beam members made of a corrugated cardboard. The beam member is made up with a body and struts. The body is constructed by overlaying the inner plates on a base platform which $1^{st}$ square prism and $2^{nd}$ square prism commonly share each other. First square prism and second square prism are coupled via struts to maintain a square prism shape of the body. The size of each of the struts is set such that both side edges contact the inner surface of the outer plates of corresponding square prisms, and load-bearing portions are provided on both side edges. A pair of struts to be folded inward is foldably connected to the ends of the inner and outer plates of the square prisms in such a manner that top and bottom ends of each of the struts touch corresponding top and bottom platforms of square prisms in a folded position, thereby interfering with the other set of struts to be kept therein.

According to the present invention, firstly, when heavily loaded corrugated cardboard pallets are exposed to transverse vibrations that are generated during transportation by a vehicle such as a truck, and a force that crushes the outer plates of beam members is applied to the side edges of the struts, the force spreads out from the outer plates through the struts' side edges to load-bearing portions because the bottom edge of load-bearing portions directly or indirectly touch the base platform of the beam member. Crushing of the edges of the struts and destruction of beam members is thus prevented.

Secondly, a pair of struts to be folded inward are foldably connected to the square prisms' ends such that each of these struts to be folded inward touch corresponding top and bottom platforms therein while interfering with each other being held internally to be locked therein. As a result, the beam obtains enhanced pressure resistance and square prisms lock the struts therein by resisting unfolding force generated thereof. Bonding of a pallet deck plate onto a beam member thus becomes easy. In addition, in this configuration, the cut-open edge of the corrugated cardboard pallet does not expose itself. The corrugated cardboard pallet is thus protected from diminishing its pressure resistance. Consequently, the pallet is resistant to strong impact from a fork of a fork lift.

Thirdly, both the struts to be folded inward interfere with each other as being held internally. As a result, these struts once held internally will not inadvertently pop out. The pallet structure is thus enhanced by consistent pressure resistance where no pop out interruption occurs.

It is desirable that a pair of struts folded inward has engagement portions for maintaining the mutual pushing state thereof.

It is not always required that a pair of struts be connected to each other. It is desirable, however, that they be coupled with each other because coupled struts are more manageable and convenient for assembly.

In light of the coupling mode, either bottom edge to bottom edge coupling via a linking plate or side edge to side edge coupling via a linking plate may be desirable wherein the side edges contact the outer plates of each of the square prisms. This technique ensures spreading of the force applied from the outer plate to one end of a strut.

As to the load-bearing portion, it is desirable that the bottom edges of struts directly or indirectly touch the base platform of the beam member. This further enhances dispersion of the force applied from the outer plate toward the side edges of the strut.

When the bottom edge of one strut is coupled to the bottom edge of another strut via a linking plate to construct a load-bearing portion, the load-bearing portion is foldably connected via folding lines along the side edges of each strut; the load-bearing portion is made up with flaps that extend toward inner plate in an inclined manner such that the flaps contact the inner plates. It is desirable that the bottom edge of each flap directly or indirectly contact the base platform, and that the size of the flaps housed in the same square prism be set such that tips of the flaps interfere with each other. The function of the load-bearing portions can thus be enhanced.

In struts, when the side edges contacting the outer plate of one of the square prisms are coupled via a linking plate, the linking plate works as a load-bearing portion. In this case, the linking plate comprises: a first linking plate that is foldably connected to one strut and a second linking plate that is foldably connected to another strut. A slit is provided at the end of one of the linking plates; a latch portion is formed at the end of another linking plate in such a manner that the latch portion extends outward at a point which corresponds to the edge of second linking plate as illustrated in FIG. 8. The desirable arrangement at the time when a slit for latching and the latch portion are engaged is that a pair of struts is assembled with linking plates to provide a square shape in a plan view. Handling of a set of square prisms and linking plates of the beam member is thus made easier.

DETAILED DESCRIPTION OF THE PREFERRED EMBODIMENTS

Figure 1:
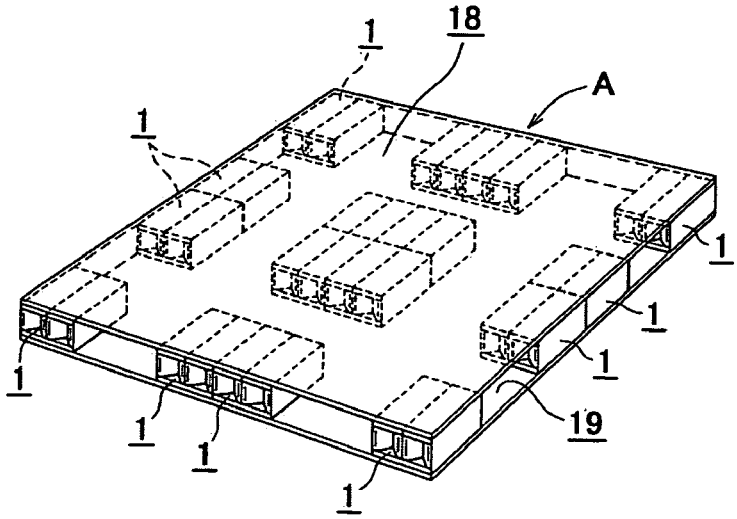
FIG. 1 is a perspective view of an embodiment of the corrugated cardboard pallet of the present invention.

The present invention is described herein with reference to embodiments illustrated in the drawings.

FIG. 1 illustrates an embodiment of the corrugated cardboard pallet of the present invention. Corrugated cardboard pallet deck plates 18 and 19 are bonded to both upper and lower surfaces of multiple corrugated cardboard beam members 1 spaced from each other in such a manner that a forklift can insert its fork from all sides.

Figure 2:
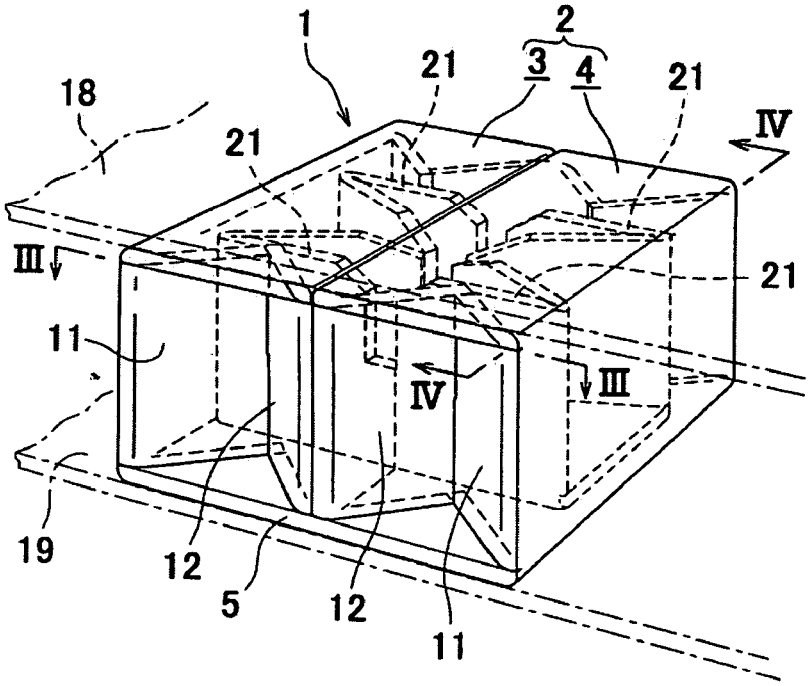
FIG. 2 is a perspective view of the beam member of the corrugated cardboard pallet of FIG. 1.
Figure 8:
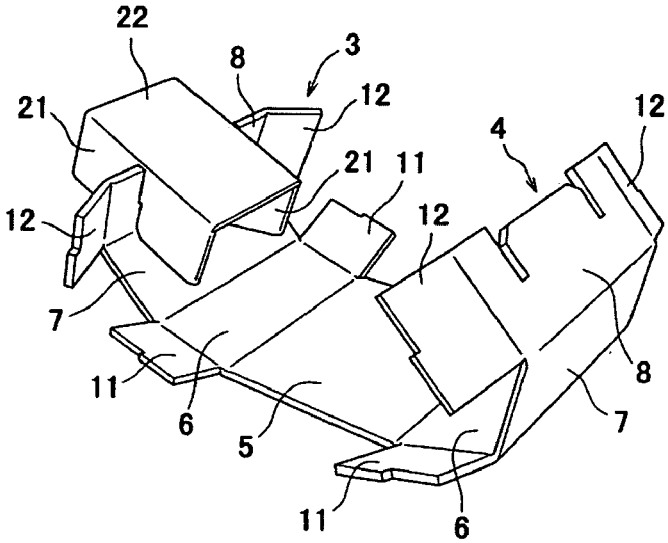
FIG. 8 is a perspective view of the beam member on its way to being assembled in the first phase.
Figure 9:
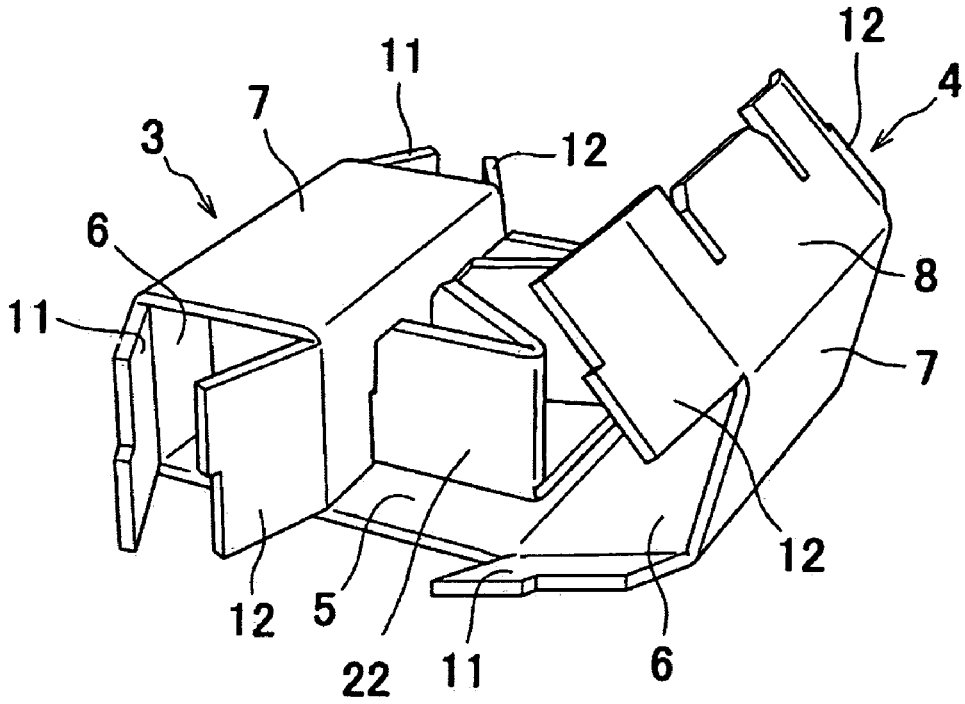
FIG. 9 is a perspective view of the beam member on its way to being assembled in the second phase.
Figure 10B:
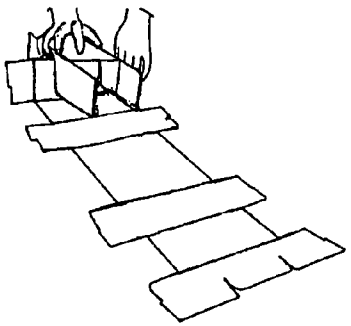
FIGS. 10(*a*) to (*n*) are perspective views of the strut and load-bearing portion of the beam member of FIG. 2.
Figure 10D:
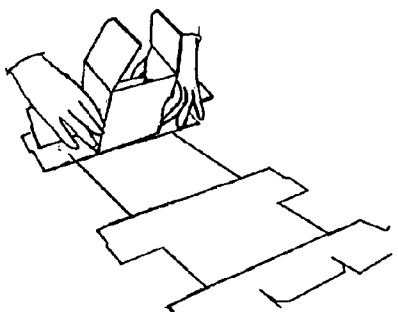
Figure 10A:
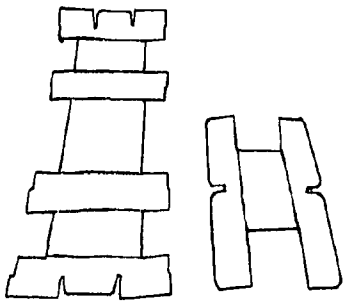
Figure 10C:
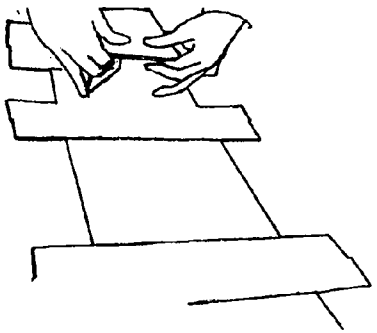
Figure 10F:
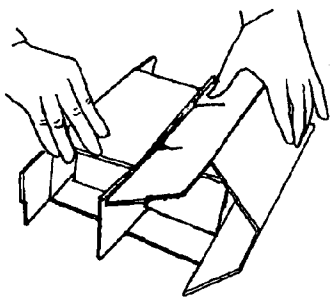
Figure 10H:
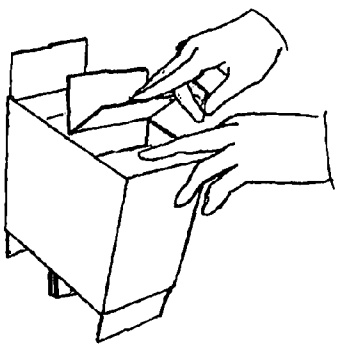
Figure 10E:
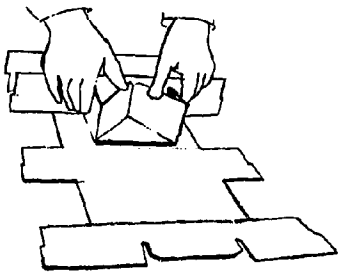
Figure 10G:
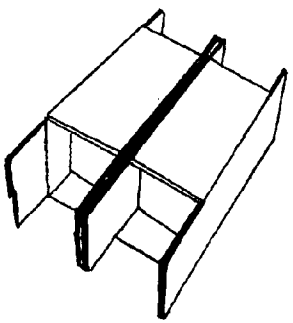
Figure 10J:
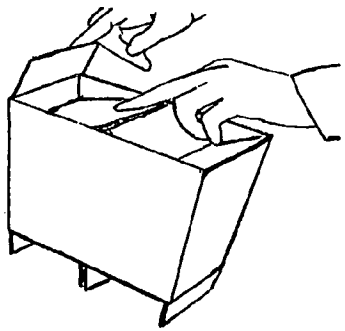
Figure 10L:
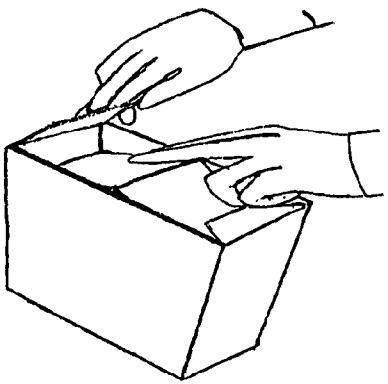
Figure 10I:
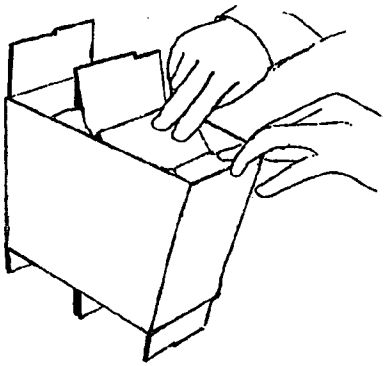
Figure 10K:
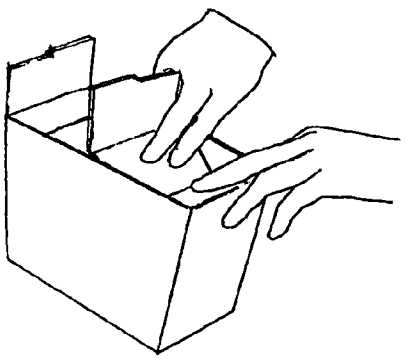
Figure 10N:
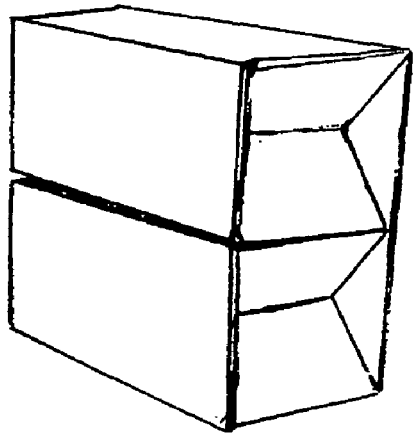
Figure 10M:
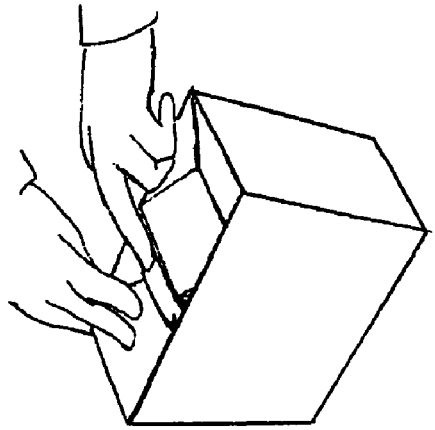

As illustrated in FIG. 2, a beam member 1 is constructed with a body 2 and struts 11. Overlaying inner plates 8 of first square prism 3 and that of second square prism 4 on a common base platform 5 provides body 2. Struts 21, which are assembled in the manner that two assembly phases, first phase and second phase, as illustrated in FIGS. 8 and 9 are combined, help coupling the two square prisms 3 and 4 to maintain the square prism shape of beam member 1. Beam member 1 and struts 21 are made of a 7 mm thick three layered corrugated cardboard; pallet deck plates 18 and 19 are made of a 10 mm thick three layered corrugated cardboard. However, the type and thickness of a corrugated cardboard is not limited to this.

Figure 6:
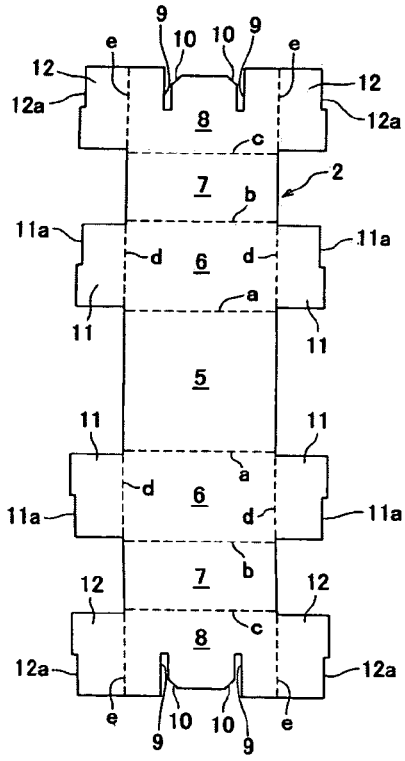
FIG. 6 is an exploded plan view of the body of a beam member.

FIG. 6 is an expanded plan view of beam member body 2: outer plate 6, top platform 7 and inner plate 8 that constitute first square prism 3 are foldably connected to one end of base platform 5 via folding lines (a), (b) and (c), respectively; outer plate 6, top platform 7 and inner plate 8 that constitute $2^{nd}$ square prism 4 are foldably connected to the other end of base platform 5 via folding lines (a), (b) and (c), respectively.

First struts 11 to be folded inward are foldably connected to both ends of each of the inner plate 8 in both square prisms 3 and 4 via folding lines (d). The upper half of the free end of first strut 11 to be folded inward is provided with slit 11*a*, thereby providing engagement portion 11*b* at the lower half of the free end of first strut 11.

In contrast, second struts 12 to be folded inward are foldably connected to both ends of each of the inner plate 8 in both square prisms 3 and 4 via folding lines (e). The upper half of the free end of first strut 12 to be folded inward is provided with engagement portion 12*b*, thereby providing slit 12*a* at the lower half of the free end of first strut 12, which is in contrast to the way the slit 11(*a*) and (*b*) were formed for first strut 11 to be folded inward.

In FIG. 6, each inner plate 8 is also provided with a pair of slits 9 in the middle of the bottom edge thereof in a longitudinal direction. In addition, the portion that is to be latched with struts 21 between a pair of slits 9 is set in such a manner that the longitudinal position of the bottom ends of struts 21 is set higher than both sides such that the portion that is to be latched with struts 21 via a pair of slits 9 contacts the upper surface of linking base plate 22 described later. Guiding taper 10 is provided in the vicinity of slits 9 to be coupled to struts.

Figure 7:
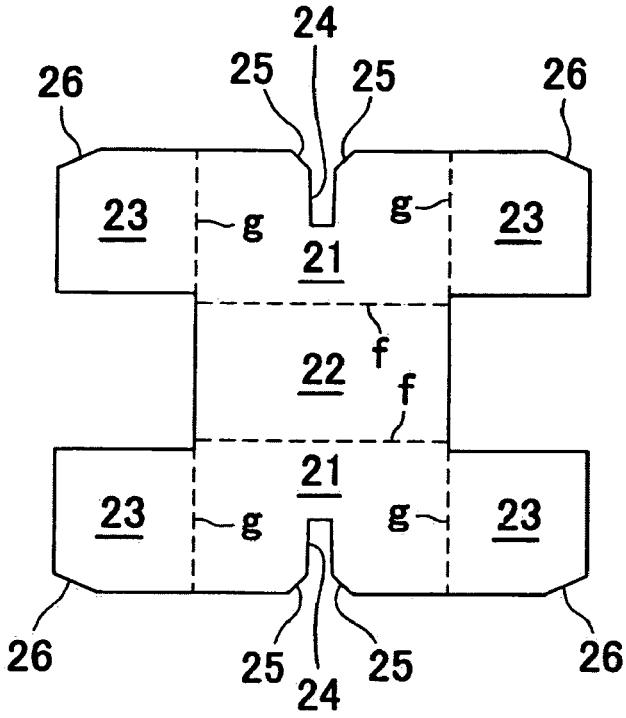
FIG. 7 is an exploded plan view of struts and load-bearing portions of beam members.

FIG. 7 is a plan view of a pair of struts 21 in an extended state: a pair of struts 21 are foldably connected to the side edges of linking plate 22 that are facing each other via folding lines (f), and flaps 23 are also foldably connected to side edges thereof via folding lines (g) wherein flaps 23 work as load-bearing portions.

The size of each strut 21 is set such that both side edges thereof contact the inner surfaces of outer plates 6 of square prisms which correspond to ends of side edges of strut 21, and slit 24 to be latched with the inner plate of a square prism is provided in the center of the upper end of strut 21 in the vertical direction. In the vicinity of the upper end of slit 24 to be latched with the inner plate of a square prism, guiding tapers 25 are provided such that inner plate 8 of a square prism can be easily engaged with slit 24.

Figure 3:
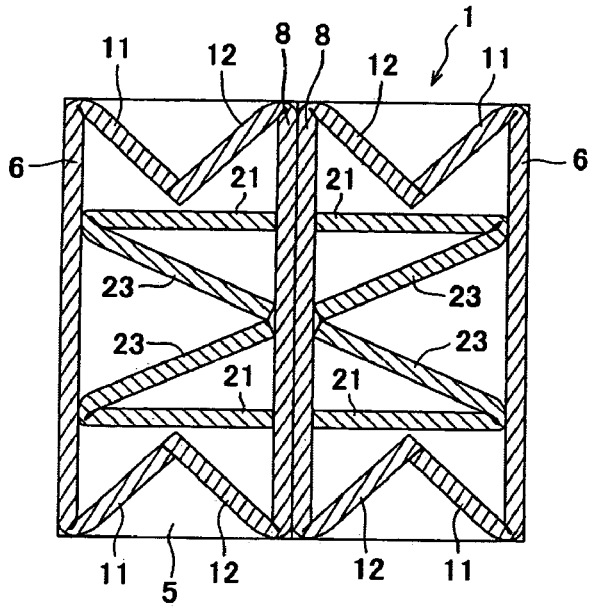
FIG. 3 is an enlarged cross section along III—III of the beam member of FIG. 2.
Figure 4:
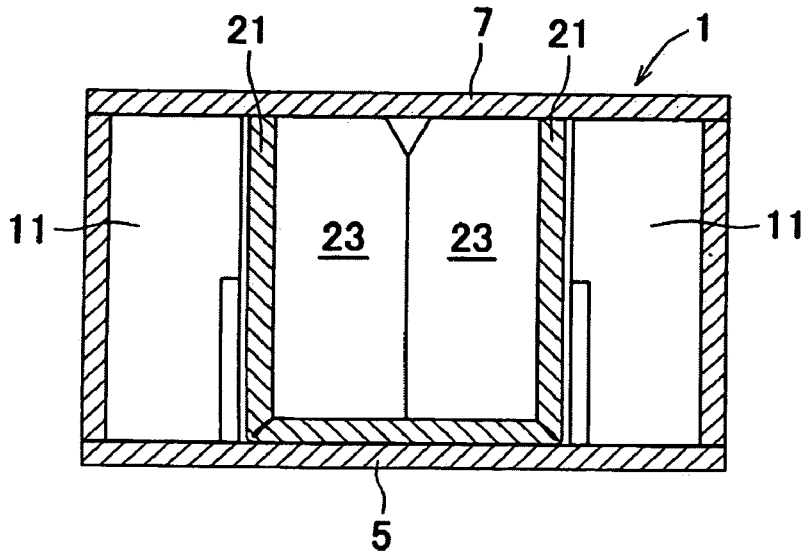
FIG. 4 is a cross section along IV—IV of the beam member of FIG. 2.

The tip of each flap 23, the load-bearing portion, as illustrated in FIG. 3, contacts corresponding inner plate 8, and the size of flaps 23 that are housed in the square prisms 3 or 4 is set such that the tips of flaps 23 interfere with squeezed against each other. In addition, the bottom edges of flaps 23 are set such that they contact linking plates 22 as illustrated in FIG. 4. On the upper end of flap 23, guiding taper 26 is provided such that inner plate of square prism inner plate 8 of a square prism can be easily engaged with slit 24 in a manner similar to guiding taper 25 described above.

Figure 5:
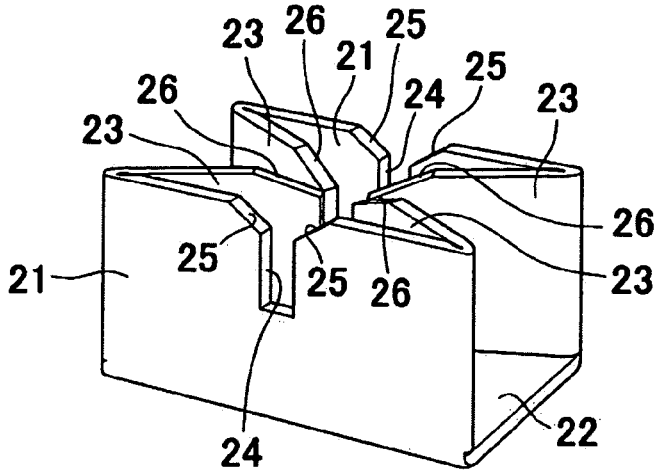
FIG. 5 is a perspective view of struts.

Beam member 1 in the extended state is assembled to make a desired square prism shape in the following manner with reference to FIG. 5: first, let a pair of struts 21 that are connected to each other via linking plate 22 stand out from linking plate 22; fold each of the struts 23 inside in such a manner that, in one square prism 3 or 4, one half body of strut 21 and flap 23 that are folded inward at the end of strut 21 is followed by inward folding of the other half body of strut 21 and flap 23 that are folded inward at the end of the half body strut 21 so as to form a "M" shape, which can clearly be observed in a cross section of a finished beam illustrated in FIG. 3.

Next, a pair of struts 21 are latched with inner plates inner plates 8 of first square prism while maintaining the M shape with flaps 23 as illustrated in FIG. 8. In other words, slits 9 of first square prism are latched with slits 24 of strut 21 to link struts 21 and inner plate 8 of first square prism 3.

Struts 21 and first square prism 3 thus connected are folded inward in a wrapping manner on beam base platform 5 as illustrated in FIG. 9. Then, a given portion of second square prism 4 is folded in a manner that slits 9 on inner plate 8 and slits 24 of struts 21 are latched together, thereby leveling top platform 7 of first square prism 3 and top platform 7 of second square prism 4.

Finally, first strut 11, to be folded inward and second strut 12, to be folded inward are folded into the edge of square prisms 3 and 4 such that engagement portions 11*b* and 12*b* are latched with struts 11 to be folded inward. More specifically, first of all, first strut 11 to be folded inward is folded into the edge of first square prism 3 and second strut 12 to be folded inward is folded into the edge of the same first square prism 3. As folding second strut 12 inward, the free end thereof touches first strut 11 in such a manner that first strut 11 pushes against second strut 12. As second strut is further pushed inward against the resistance from first strut 11, engagement portions 11*b* and 12*b* meet on back of struts 12 and 11 over slits 12*a* and 11*a*. Both struts 11 and 12 to be folded inward are thus locked therein. The assembly of beam member 1 is thus completed.

Presence of flaps 11 and 12 that are folded inward and locked into both ends of square beam members 3 and 4 makes beam member 1 and ensures prevention of top platform 7 of a square beam from popping up. Consequently, the need for bonding inner plates 8 of square prisms 3 and 4 is eliminated.

Top pallet deck plate 18 is bonded on top of a given number of beam members 1, and bonding bottom pallet deck plate 19 onto the bottom of beam members 1 finishes assembly of corrugated cardboard pallet (A) of the present invention illustrated in FIG. 1. During the bonding process, top platform does not inadvertently pop up, making bonding of the top pallet deck plate 18 easier as well.

The corrugated cardboard pallet of this embodiment is constructed with 16 beam members 1, each 95 mm high, arranged between top and bottom pallet deck plates 18 and 19 of 1100 mm length×1100 mm width. These beam members 1, are arranged in a manner illustrated in FIG. 1.

The resulting corrugated cardboard pallet (A) was tested for its compression resistance in a comparative test and a comparative analysis of the present invention and a conventional corrugated cardboard pallet. The control was constructed in the same manner as that of the present invention except that it did not have flaps to be folded inward: the top and bottom pallet deck plates of controls had the size and used the same material as the present invention; beam members of controls had the size and used the same material as the present invention; ways to arrange top and bottom pallet deck plates are further analyzed. It was proven that the corrugated cardboard pallet of the present invention tested in this embodiment had a significantly better compression resistance than that of the controls (See Table 1).

The objective of this comparative test was to measure how much load is required to deform the corrugated cardboard pallet. The compression test method was in compliance with the Japan Industrial Standard (JIS) Rule 0212: 1998.

In this comparison test, the initial load was 200N (20.4 kgf) and it took 5 minutes and 30 seconds until the maximum load was applied to the corrugated cardboard pallet.

TABLE 1

| | Sample | Load N (kgf) | Amount Deformed (mm) | Maximum Load N (kgf) | Amount Deformed (mm) |
|---|---|---|---|---|---|
| Sample | 1 | 73000 (7450) | 25 | 116000 (11800) | 38 |
| | 2 | 75600 (7710) | 25 | 115000 (11700) | 38 |
| | 3 | 72300 (7380) | 25 | 116000 (11800) | 39 |
| Control | 1 | 37200 (3800) | 25 | 56000 (5710) | 36 |
| | 2 | 40100 (4090) | 25 | 56900 (5810) | 37 |
| | 3 | 41300 (4210) | 25 | 54700 (5580) | 35 |

As described above, the corrugated cardboard of the present invention has an improved pressure resistance and water resistance taking advantage of its configuration in which a part of cut-open surface of the corrugated cardboard is not exposed in the beam member's height direction. Water absorption through the cut-open surface of a corrugated cardboard is thus prevented. The present invention has a wide variety of uses in industrial applications.

Figure 11:
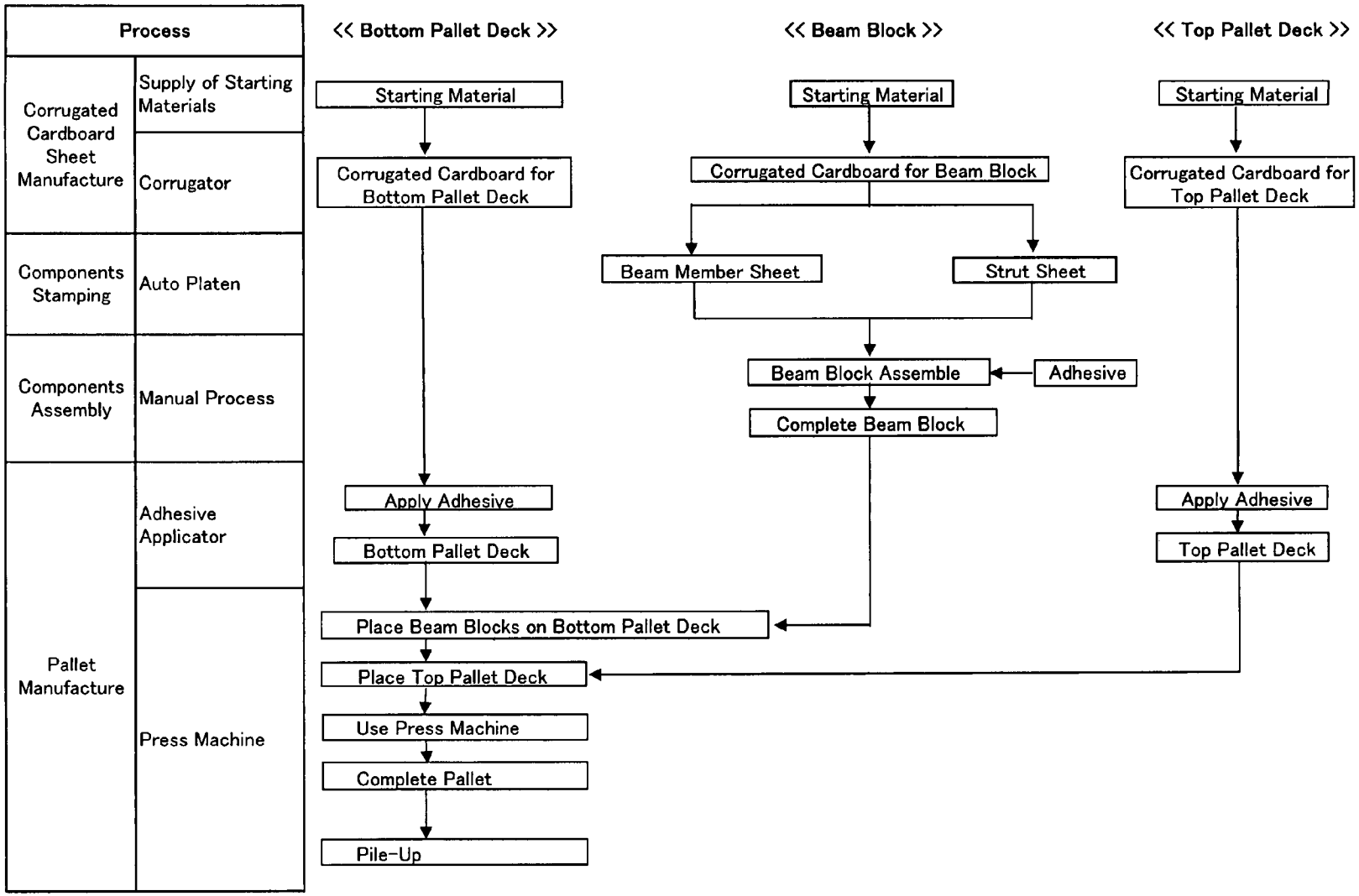
FIG. 11 is a flow chart showing how to make the beam members, top and bottom deck and manufacturing method for corrugated cardboard pallet A.

FIG. 11 illustrates a flow chart for manufacturing a corrugated cardboard pallet A. As illustrated in FIGS. 10(*a*) to 10(*n*), the beam body and the struts both of which are made of corrugated cardboard material are prepared to complete beam blocks. Top pallet deck plate and bottom pallet deck plate 19 are also made of a corrugated cardboard material. A predetermined number of the beam blocks are placed on the bottom pallet deck plate 19 and the top pallet deck 18 is placed over the bottom pallet deck plate 19 via the beam blocks and processed with a press machine to complete the manufacture of the corrugated cardboard pallet A. As seen from FIG. 10, the beam blocks are made through manual process to eliminate the need of complicated and expensive automatic working tools, so the manufacturing plant for making the bottom pallet decks and the beam blocks are simplified and made inexpensive.

What is claimed is:

1. A corrugated cardboard pallet comprising a pallet deck plate fixed onto an upper surface and optionally a lower surface of at least one beam member made of corrugated cardboard, wherein said at least one beam member comprises:

a) a body having a first square prism and a second square prism, wherein said body is made by overlaying inner plates on a common base platform, and b) struts that provide a square prism shape for said body by coupling said first and second square prisms, wherein said struts are sized such that at least one strut side edge contacts an inner surface of an outer plate of said first and second square prisms, and load bearing portions are provided on at least one strut side edge, wherein a pair of struts to be folded inward are foldably connected to an end of said inner and outer plates of said first and second square prisms in such a manner that top and bottom ends of said struts touch a corresponding top platform and bottom platform of said first and second square prisms in a folded position.

2. The corrugated cardboard pallet as set forth in claim 1 wherein said load bearing portions are made up of flaps having tips for engaging said struts.

3. The corrugated cardboard pallet as set forth in claim 2 wherein said load bearing portions are foldably coupled with each other at the at least one strut side edge via folding lines and said flaps extend toward said inner plates in an inclined manner and contact said inner plates, wherein a bottom edge of said flaps directly or indirectly contact said base platform of said beam member and said tips of said flaps interfere with each other.

4. The corrugated cardboard pallet as set forth in claim 1 wherein a bottom edge of said load-bearing portion directly or indirectly contacts the base platform of said beam member.

5. The corrugated cardboard pallet as set forth in claim 1 wherein said struts have bottom edges that are foldably coupled with each other via linking plate.

6. A corrugated cardboard beam member made of corrugated cardboard comprising:

a) a foldable body having inner plates and outer plates, b) foldable struts, and c) a body having a first square prism and a second square prism, said body made by overlaying said inner plates on a common base platform and said struts provide a square prism shape for said body by coupling said first and second square prisms, wherein said struts are sized such that at least one strut side edge contacts an inner surface of said outer plates of corresponding said first and second square prisms, and load bearing portions are provided on at least one strut side edge; wherein said struts are foldably connected to ends of said inner and outer plates of said first and second square prisms in such a manner that top and bottom ends of said struts touch a corresponding top platform and bottom platform of said first and second square prisms in a folded position, and said load-bearing portions and said struts are provided and arranged in an "M" shape.

7. A method of manufacturing a corrugate cardboard pallet, comprising fixing a pallet deck plate onto at least an upper surface of a beam member made of corrugated cardboard, wherein said beam member comprises a body having a first square prism, and a second square prism, said body made by overlaying inner plates on a common base platform and struts that provide a square prism shape for said body by coupling said first and second square prisms, wherein said struts are sized such that at least one strut side edge contacts an inner surface of an outer plate of corresponding said first and second square prisms, and load bearing portions are provided on said at least one strut side edge, wherein said struts are foldably connected to ends of said inner and outer plates of said first and second square prisms in such a manner that top and bottom ends of said struts touch a corresponding top platform and bottom platform of said first and second square prisms in a folded position, and said load-bearing portions and said struts are provided and arranged in an "M" shape.

8. A method of manufacturing a corrugated cardboard beam member for use with a pallet comprising a pallet deck plate fixed onto an upper surface of multiple beam members made of corrugated cardboard comprising the steps of:

a) preparing a beam body of corrugated cardboard having a first square prism and a second square prism, said body made by overlaying inner plates on a common base platform, and b) preparing struts of corrugated cardboard that provide a square prism shape for said body by coupling said first and second square prisms, wherein said struts are sized such that at least one strut side edge contacts an inner surface of an outer plate of corresponding said first and second square prisms, and load bearing portions are provided on said at least one strut side edge, wherein said struts are foldably connected to ends of said inner and outer plates of said first and second square prisms in such a manner that top and bottom ends of said struts touch a corresponding top platform and bottom platform of said first and second square prisms in a folded position, and said load-bearing portions and said struts are provided and arranged in an "M" shape.

9. A method of manufacturing a corrugated cardboard beam member for use with pallet comprising, a pallet deck plate fixed onto an upper surface of multiple beam members made of corrugated cardboard, comprising the steps of:

preparing beam body of corrugated cardboard having a first square prism and a second square prism, said body made by overlaying inner plates on a common base platform through manual operation, and preparing struts of corrugated cardboard for providing a square prism shape for said body by coupling said first and second square prisms in the beam body through manual process, said struts are sized such that at least one strut side edge contacts an inner surface of corresponding said first and second square prisms, said struts serving as load-bearing portions on at least one strut side edge, wherein said struts are foldably connected to ends of said inner and outer plates of said first and second square prisms in such a manner that top and bottom ends of said struts touch a corresponding top platform and bottom platform of said first and second square prisms in a folded position, and said load-bearing portions and said struts are provided and arranged in an "M" shape.

* * * * *